United States Patent [19]

Morrell et al.

[11] 4,072,015

[45] Feb. 7, 1978

[54] BOREHOLE AEROSTATIC GROUND SUPPORT SYSTEM

[75] Inventors: Roger J. Morrell, Bloomington; Jerome A. Gunn; Richard J. Wilson, both of Minneapolis, all of Minn.

[73] Assignee: The United States of America as represented by the Secretary of the Interior, Washington, D.C.

[21] Appl. No.: 755,917

[22] Filed: Dec. 30, 1976

[51] Int. Cl.[2] ..... E21D 5/00

[52] U.S. Cl. ..... 61/35; 61/45 F; 299/11

[58] Field of Search ..... 61/35, 45 F; 299/11, 299/33

[56] References Cited

U.S. PATENT DOCUMENTS

| | | | |
|---|---|---|---|
| 2,990,166 | 6/1961 | Walsh | 61/45 F |
| 3,892,076 | 7/1975 | Oudenhoven | 61/35 |
| 3,937,025 | 2/1976 | Alvarez et al. | 61/35 |

FOREIGN PATENT DOCUMENTS

| | | | |
|---|---|---|---|
| 1,069,549 | 11/1959 | Germany | 299/11 |
| 381,767 | 8/1973 | U.S.S.R. | 299/11 |

*Primary Examiner*—Paul R. Gilliam
*Assistant Examiner*—David H. Corbin
*Attorney, Agent, or Firm*—Thomas Zack; Donald A. Gardiner

[57] ABSTRACT

A method and the apparatus for implementing the method to provide temporary ground support in a mine. After an auger or other type of hole has been bored in an underground mine, at least one inflatable bladder with a fluid conduit therethrough is inserted into the hole. Once the bladder is inflated it expands to fill the hole's diameter and to act as a plug. Thereafter, fluid is forced through the fluid conduit past the bladder and into the hole cavity to act in conjunction with the bladder as a ground support for the hole. Appropriate fluid valves, meters, and conduits are placed at the input to the fluid conduit to control and measure the fluid being forced into the bladder and the hole cavity. Quick connect-disconnect couplings are provided when two or more bladders are connected seriatim and placed within the hole.

5 Claims, 3 Drawing Figures

BOREHOLE AEROSTATIC GROUND SUPPORT SYSTEM

FIELD OF THE INVENTION

Our invention is a method and apparatus to provide support and stabilization to an underground mine.

DESCRIPTION OF THE PRIOR ART

Within the mining field underground support has been provided by inflatable flexible containers of various shapes and sizes. A good explanation of some of these prior art containers can be found in the U.S. Pat. No. 2,990,166 to M. A. Walsh. As shown in FIGS. 1 and 2 of the Walsh patent, the proper support is provided when the inflated containers span the roof to floor and come into bearing contact with them (column 4, lines 5–14). One of the disadvantages with these types of supports is that they provide immediate support only to the mine bearing surfaces in contact therewith and perhaps a small adjacent roof area. Thus, in auger mining where the boreholes may easily be 100 or more feet in length and around 18 to 60 inches in diameter an exceedingly large and expensive inflatable support would have to be provided to fill the borehole cavity.

Another method that has been used in the past to support the overburden, especially in the tunnelling art, is that referred to as the plenum process or compressed-air method. The book entitled "Practical Tunnel Driving," by Harold Richardson and Robert S. Mayo — 1975 McGraw Hill Book Co. (1st Edition 1941) on pages 275–300 describe this method as does the book "Tunnels and Tunnelling" edited by C. A. Pequignot, Hutchinson and Co., Ltd., London (1963), pages 158 to 184. Essentially what this method does is to provide compressed air to a tunnel lining which has been locked off from the free air side to allow the working face area to be under air pressure. Depending on such variables as the ambient materials making up the tunnel, the depth below water level, and the safety considerations for the workers, the pressure and amount of compressed air is determined and controlled to prevent the water and surrounding material from collasping on the workers or from exploding outwardly towards the water's surface.

Our present invention utilizes an inflatable container and some of the principles in the compressed-air method to provide support for the overburden above a mine borehole. Usually, it does this to provide a temporary light weight portable support that can be removed when desired to allow a controlled collasping of the overburden. None of the known prior art combines an inflatable container with the compressed-air principles to achieve such an effective borehole support which is also safe, readily portable, small in size, and low in cost for use within the confines of a mine.

SUMMARY OF THE INVENTION

The borehole support of this invention consists of an inflatable container mounted in a mine borehole having a conduit to allow pressurized fluid to be injected thereto and a conduit to allow pressurized fluid to be forced through the container. After the container has been inflated to fill the diameter of the borehole to act as a sealing plug therein, pressurized fluid at controlled pressure level is forced through the container to the borehole cavity behind the plug to act as an overburden support.

The primary object of this invention is an improved method and apparatus to provide inflatable support for use in mine boreholes.

BRIEF DESCRIPTION OF THE DRAWINGS

As shown in FIG. 1, the inflatable enlongated first container 1 is inflated and in situ within the underground mine borehole 3. To the right of the container is the borehole's deadend cavity which may be created by the natural end of the hole or by plugging the free end of the open hole by another inflatable container similar to the first. When so placed, these containers provide support for the borehole overburden 5 immediately above it and more importantly, seal the borehole for later pressurization. Extending the total length of the container through its centerline is the fluid conduit 7. This conduit receives its input of compressed fluid, usually air through a tubular hose 10, from a compressor or pump located to the left. To control the amount of fluid entering the conduit via manifold coupling 9, a conventional valve 17 with its external handle is employed in conjunction with the fluid pressure meter 11. Inflatable container 1 is filled through valve 13 from the same coupling 9 and fluid pressure source. Pressure meter 15 acts in conjunction therewith to accurately indicate the amount of pressure in the container.

Figure 1:
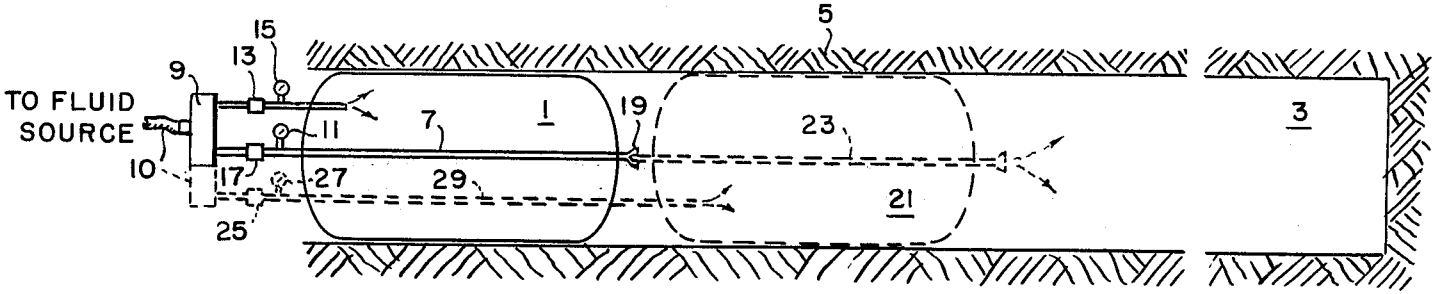
FIG. 1 schematically illustrates the preferred embodiment of our invention in a cross-sectional view with one container or two containers (in phantom lines) in situ within a mine borehole.

At far end of the conduit—to the right—is the quick connect coupling 19 which may allow a second inflatable container 21 with a through conduit 23 (shown in phantom lines) to be connected in fluid communication in seriatim with container 1. Connecting two containers in series would increase the safety factor. Either container by itself would be capable of containing the pressurized borehole fluid. Thus the chances of a major blowout would be reduced should either container rupture. This second container is similar to the first described. It would have an input valve 25 and meter 27 like valve 17 and meter 11 so that it could be filled via conduit 29 independently of the fluid being sent to the borehole cavity.

Figure 2:
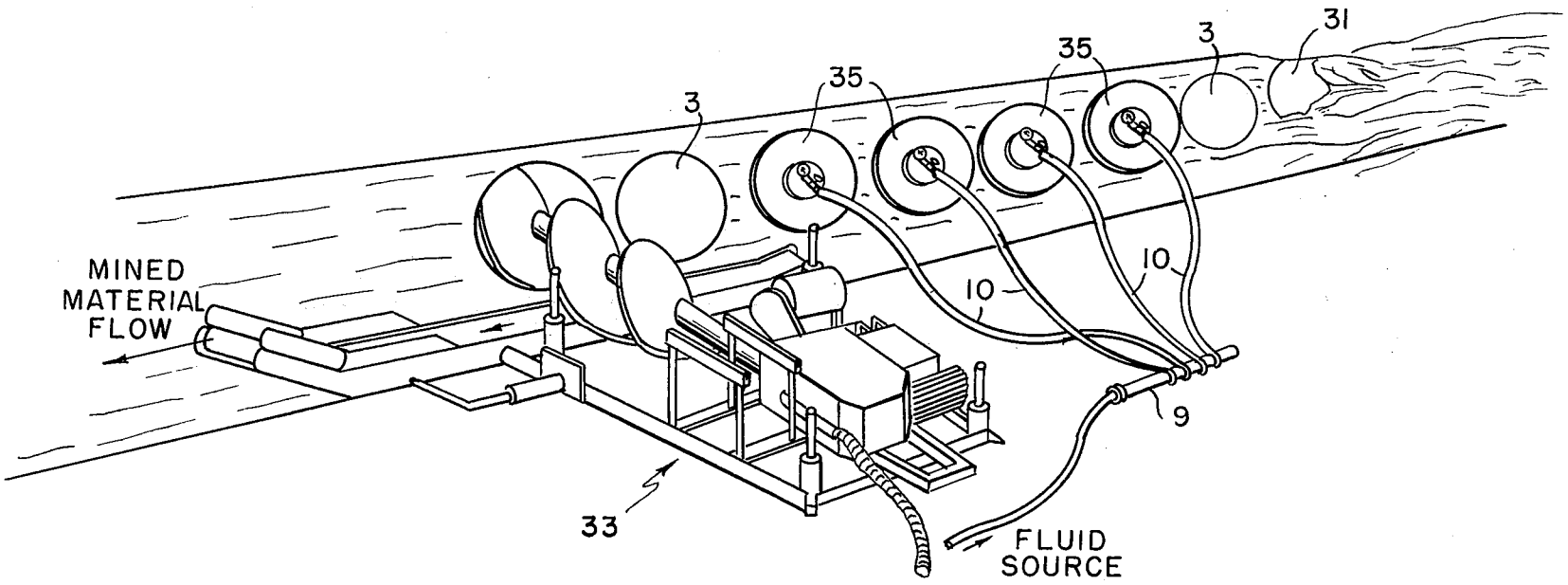
FIG. 2 shows a typical auger-mining operation employing our invention.

Initially, compressed fluid is inputted past control valve 13 and pressure meter 15 so that it exits into the container 1. After this container is inflated to a predetermined pressure level, it forms a fluid tight borehole plug. Assuming this is the only container, valve 17 is then opened to allow the pressurized fluid to enter the borehole cavity to the right of the container. Upon entering this cavity the fluid begins to increase the pressure level therein until it is filled and a predetermined pressure level achieved. Once the fluid pressure levels in the first container and the borehole cavity have been achieved, they are maintained as long as desired to give the needed overburden support. When it is desired to remove the container and allow the borehole to collapse, the fluid pressure is simply reduced and the container removed. In an actual working arrangement, we contemplate many of these containers with at least one in separate different boreholes as shown in FIG. 2. By systematically allowing their pressure to be reduced and removing them, it is possible to cause a large mine section to collapse under the weight of its overburden in a controlled manner.

The predetermined pressure level selected for inflating the container and the closed mine cavity depends to a large degree on the overburden weight. For example, rock weighs approximately 144 pounds per cubic foot so that it exerts about 1 pound per square inch (psi) of pressure. Therefore, if the overburden were a thickness of 100 feet of rock, 100 psi of gauge pressure would support the overburden. Actually, for rock, because of its tendancy to bridge over excavations and be self supporting to some extent, it is not necessary to have as much as 1 psi pressure for each foot of overburden. In many systems only a few psi of fluid pressure is needed to be effective. For the majority of mining operations employing augers to establish the boreholes, fluid support gauge pressures between 5 to 100 psi should be sufficient.

The typical auger hole employing our invention would be 18 to 60 inches in diameter and about 100 feet in length. The inflatable container would be between 4 to 20 feet in length and made out of neoprene reinforced with plys of nylong tire cord or such similar construction. Either one or a series of fluid interconnected containers may be used depending on the amount of surface bearing contact and degree of safety desired.

Normally, as in our preferred embodiment, compressed air is used to inflate the first container forming the plug plus the closed mine cavity. However, other fluids such as foams, water vapor or water could also be used for either or both of these functions. Factors such as safety, cost, and availability would have to be considered in selecting the fluids.

Our invention was initially developed for auger borehole drilling in coal mines in which there was to be a row of horizontal holes as depicted in FIG. 2. Once the inflated plugs were placed in each hole and their respective cavities filled with the pressurized fluid, support was provided to the overburden. Upon the completion of mining operations or at some other desired time the plugs were to be systematically removed to provide for a controlled collasping of the overburden as is borehole 31. When in a supporting position, our invention allows the auger boreholes to be drilled much closer together than would unsupported boreholes thus allowing the extraction of a greater percentile of the in situ coal. It does this by providing the safety support necessary with a portable, easily set up, inexpensive, and reuseable invention. The amount of roof support provided by our invention is a function of the borehole pressure and the borehole diameter. The support force provided along each foot of hole for various levels of pressure and borehole diameters is given in the following table.

| Support Force, in Pounds, Per Foot of Borehole | | | | | |
|---|---|---|---|---|---|
| Borehole Diameter | Pressure, psi | | | | |
| (in) | 5 | 10 | 20 | 50 | 100 |
| 24 | 1,440 lbs/ft | 2,880 | 5,760 | 14,400 | 28,800 |
| 36 | 2,160 | 4,320 | 8,640 | 21,600 | 43,200 |
| 48 | 2,880 | 5,760 | 11,520 | 28,800 | 57,600 |

In FIG. 2, the series of horizontal boreholes 3 drilled by a conventional auger system 33 are shown in various stages. To the right there is the collasping borehole 31 next to a borehole 3 whose inflatable support container-plug has just been removed. To the left of this unsupported borehole are shown four additional supported boreholes with end caps 35 of the containers 1 along with their meters 11 and 15. Each supported borehole set up is identical to the FIG. 1 solid line system. The unsupported borehole 3 to the left of these four supported boreholes has just been drilled by the operating conventional auger system 33 and will shortly be supported by our invention. A conventional mine haulage system like rail cars or a conveyor belt receives the material extracted by the auger system and moves it to the left towards the surface.

Figure 3:
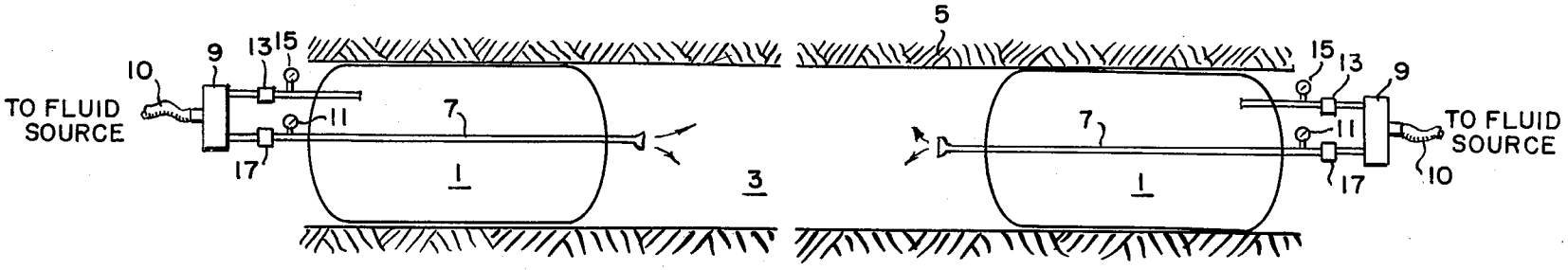
FIG. 3 depicts in cross-sectional view a panel auger-mining system employing our invention wherein an auger hole is bored through a coal panel.

A somewhat different arrangement is shown in FIG. 3 employing our invention in a panel auger-mining system wherein an auger hole is bored through a coal panel breaking out into a prepared opening. The two containers 1 each act as plugs to seal both ends of the borehole 3 with the volume therebetween receiving the overburden supporting pressurized fluid from conduits 7.

Although our preferred embodiment illustrated two inflatable containers connected in seriatim, it could have also employed one or three or more containers all being fluid tight and allowing fluid communication to the borehole cavity at its far end. In the case of a borehole with both ends open, one or more inflatable containers would be placed at each end. These inflatable containers would seal the hole which could then be pressurized from either or both ends as already described. The number used or their exact construction is not important to our invention which is to be measured only by the scope and spirit of the claims that follow.

We claim:

1. A method for providing temporary ground support to an underground auger mining area comprising the steps of:

(a) drilling a series of aligned auger holes into the working face of a mine;

(b) inserting an inflatable container lengthwise into each of the drilled auger holes;

(c) connecting a source of pressurized fluid to each of the containers at a specific time to cause it to expand to the borehole's size to provide a pressure tight plug therein;

(d) forcing a fluid at a predetermined pressure through each of said inflated containers to fill the borehole's cavity located more remote from the mine face; and (e) sequentially deflating the boreholes supported by the pressurized fluids of steps (c) and (d) to allow the drilled auger holes to collaspe in a controlled manner.

2. The method of claim 1 wherein the predetermined pressure of step (d) is in a range between 1 to 100 pounds per square inch.

3. The method of claim 1 including the additional step (b) of connecting a second inflatable container to the output of the first container and inserting it into borehole before said first container and providing a means for inflating said second container.

4. The method of claim 1 including the additional step (b) of inserting a second inflatable container into the opposite end of a through borehole to act as a sealing borehole plug, and then filling the cavity between the two containers with an overburden supporting fluid.

5. The method of claim 1 wherein steps (a), (b), (c), (d), and (e) are performed in that order.

* * * * *